United States Patent [19]

Hensel

[11] Patent Number: 4,732,131

[45] Date of Patent: Mar. 22, 1988

[54] FUEL LINE PURGING DEVICE

[75] Inventor: Robert J. Hensel, Oshkosh, Wis.

[73] Assignee: Brunswick Corporation, Skokie, Ill.

[21] Appl. No.: 900,594

[22] Filed: Aug. 26, 1986

[51] Int. Cl.[4] ..... F02M 39/00

[52] U.S. Cl. ..... 123/516; 123/457; 123/514; 123/456

[58] Field of Search ..... 123/514, 516, 456, 447, 123/467, 457

[56] References Cited

U.S. PATENT DOCUMENTS

| | | | |
|---|---|---|---|
| 1,991,586 | 2/1935 | Vincent | 123/456 |
| 3,606,908 | 9/1971 | Riester | 123/516 |
| 3,789,819 | 2/1974 | Moulds . | |
| 4,079,717 | 3/1978 | Shirose . | |
| 4,393,844 | 7/1983 | Skinner . | |
| 4,440,138 | 4/1984 | Smith | 123/516 |
| 4,527,528 | 7/1985 | Finn | 123/456 |
| 4,539,959 | 9/1985 | Williams | 123/456 |
| 4,625,701 | 12/1986 | Bartlett | 123/516 |

FOREIGN PATENT DOCUMENTS

| | | | |
|---|---|---|---|
| 0083516 | 7/1983 | European Pat. Off. | 123/514 |
| 3427396 | 1/1986 | Fed. Rep. of Germany | 123/514 |
| 0048768 | 3/1983 | Japan | 123/516 |
| 0085357 | 5/1983 | Japan | 123/516 |
| 1575643 | 9/1980 | United Kingdom | 123/514 |

*Primary Examiner*—Carl Stuart Miller

*Attorney, Agent, or Firm*—Andrus, Sceales, Starke & Sawall

[57] ABSTRACT

A fuel injection system is provided with a purging device (14) for purging gas, including air and vapor, from the system. The device includes a pressure responsive valve (22) permitting gas to flow from an inlet (16) connected to the high pressure fuel injection line (8) to a vent outlet (18), and blocking flow when gas has been purged from the system and fuel pressure rises. A first branch passage (24) communicates between the inlet (16) and one side (26) of the valve (22), and a second branch passage (28) communicates between the inlet (16) and the other side (30) of the valve (22) and also with the outlet (18). A restriction orifice (34) in the second branch passage (28) provides a fuel pressure drop thereacross but does not substantially drop gas pressure thereacross, such that pressurized fuel causes a higher pressure on the one side (26) of the valve (22) than on the other side (30) of the valve (22), which pressure differential closes the valve.

11 Claims, 3 Drawing Figures

FUEL LINE PURGING DEVICE

BACKGROUND AND SUMMARY

The invention relates to fuel supply systems for fuel injected internal combustion engines, and particularly to a device for purging gases, including air and vapor, from the system. The purging device may be used in combination with the fuel injection systems shown in my co-pending application Ser. No. 808,135, filed Dec. 12, 1985, and U.S. Pat. No. 4,699,109.

In a fuel injection system, a fuel pump draws fuel from a fuel tank and delivers pressurized fuel through a pressure line to one or more fuel injectors. At initial start-up, the high pressure fuel line and the fuel pump may be devoid of fuel, particularly after a long lay-off or when the fuel system has run dry. The fuel injection system may have difficulty in pumping such air and/or vapor, and in any event requires longer engine cranking and difficult starting, as well as poor initial performance.

The present invention provides a simple and effective device for purging gases from the high pressure fuel line.

DETAILED DESCRIPTION

Figure 1:
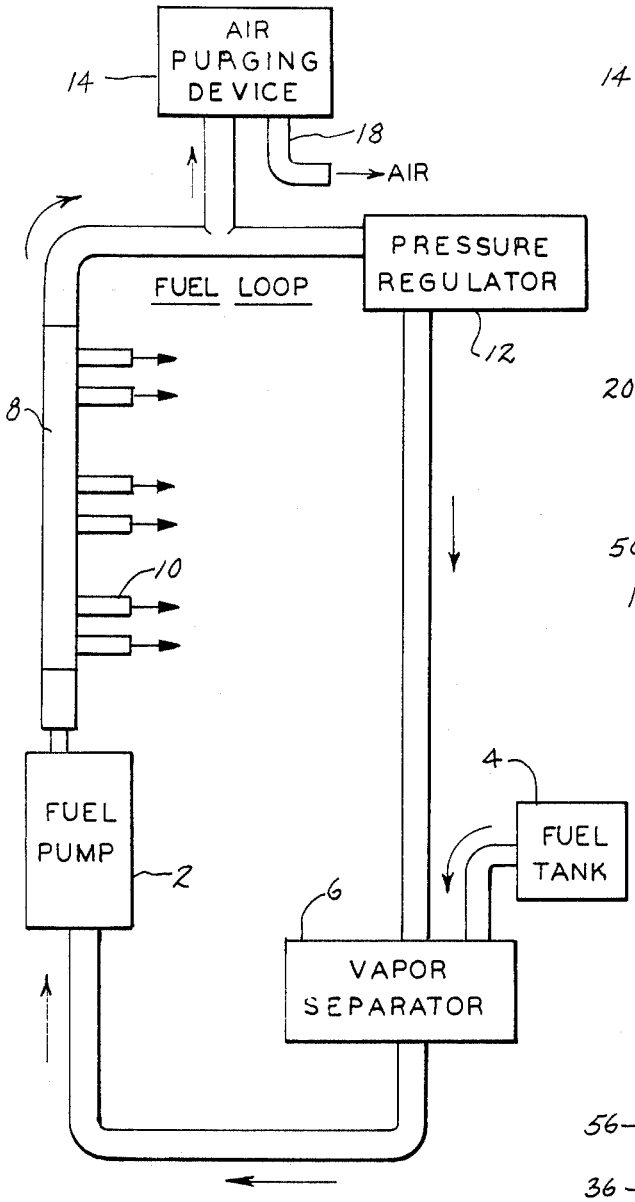
FIG. 1 schematically shows a fuel injection system.

FIG. 1 shows a fuel injection system for an internal combustion engine having a fuel pump 2 communicating with and drawing fuel from a fuel tank 4 through a float bowl or a vapor separator 6 such as shown in my above noted co-pending application Ser. No. 808,135. Fuel pump 2 delivers pressurized fuel through a pressure line 8 to one or more fuel injectors 10, with a return fuel loop provided through a pressure regulator 12 controlling the fuel pressure in line 8. Purging device 14 has an inlet 16 connected to high pressure fuel line 8, and has an outlet 18 for venting gases, including air and vapor, to the atmosphere or returning same to vapor separator 6 or fuel tank 4.

Figure 2:
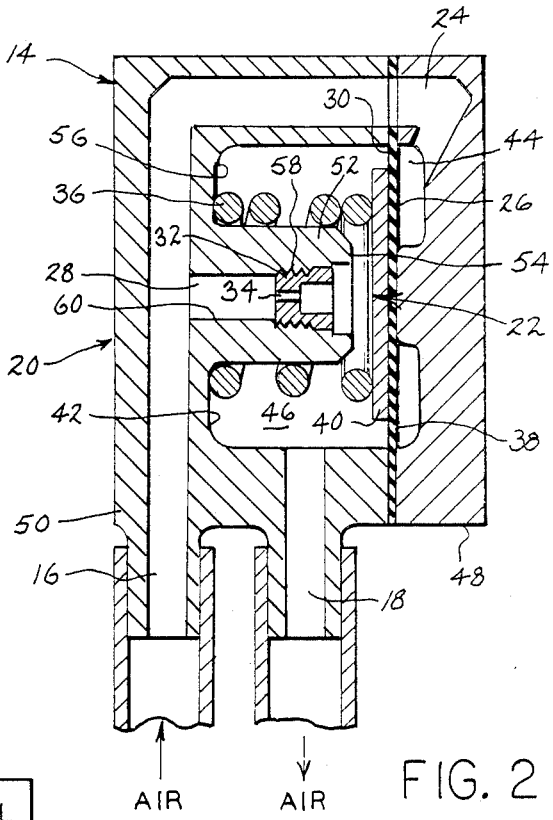
FIG. 2 is a cross-sectional view of a purging device in accordance with the invention, in an open position.

Referring to FIG. 2, purging device 14 has a housing 20 with the noted inlet 16 and outlet 18. A pressure responsive valve 22 in the housing is movable between an open position, FIG. 2, permitting flow from inlet 16 to outlet 18, and a closed position, FIG. 3, blocking flow from the inlet to the outlet. A first branch passage 24 communicates between inlet 16 and one side 26 of valve 22. A second branch passage 28 communicates between inlet 16 and the other side 30 of valve 22. Restriction means in branch passage 28 is provided by a plug 32 with a central axially extending orifice 34 therethrough. The orifice restriction is selected to provide a fuel pressure drop thereacross but not substantially dropping air and/or vapor pressure thereacross. Pressurized fuel in inlet 16 from pressure line 8 is transmitted through branch passages 24 and 28 to the respective sides 26 and 30 of valve 22 and causes a higher pressure on side 26 than on side 30, to close valve 22 by moving it leftwardly to the closed position, FIG. 3. Air and/or vapor in inlet 16 from line 8 is transmitted through branch passages 24 and 28 to the respective sides 26 and 30 of valve 22 but does not cause sufficient pressure differential across valve 22 to close same, such that valve 22 is in the rightward open position, FIG. 2.

Biasing means are provided by a compression spring 36 biasing valve 22 rightwardly to the open position such that valve 22 is normally open. The force of spring 36 is overcome by the differential pressure across valve 22 responsive to fuel pressure. Valve 22 is provided by a flexible diaphragm 38 and an attached plate 40, to be described.

In operation at start-up with the fuel system filled with air and/or vapor, the fuel pump starts to pump air and/or vapor which exits through device 14. Valve 22 is held open by spring 36, whereby the air and/or vapor may escape fuel line 8, allowing fuel pump 2 to draw fuel from tank 4 and become primed. As the pump is primed and fuel enters the fuel loop and line 8, the fuel pressure rises. The increasing fuel pressure acts on the diaphragm and moves it leftwardly to close branch passage 28 and hence shut off flow to outlet 18, FIG. 3. Fuel pressure acts on both sides 26 and 30 of the diaphragm. Orifice 34 restricts fuel flow and causes the noted pressure drop, such that for a given fuel line pressure the right side 26 of the diaphragm is acted on by full pressure and the left side 30 of the diaphragm is acted on by a lower pressure, which in turn causes a differential pressure across the diaphragm, thus causing the diaphragm to move leftwardly to the closed position. The fuel injection system is now purged of air and vapor, and device 14 does not further affect operation of the fuel injection system.

Housing 20 includes a cavity 42. Flexible diaphragm 38 and its attached plate 40 divide cavity 42 into a first chamber 44 on the right side of diaphragm 38 and a second chamber 46 on the left side of diagraphm 38. Right chamber 44 is separated and sealed from left chamber 46 in cavity 42 by diaphragm 38. Right chamber 44 communicates with first branch passage 24. Left chamber 46 communicates with second branch passage 28 through restriction orifice 34 and also communicates with outlet 18. Diaphragm 38 is mounted between and forms a sealing gasket between right and left housing sections 48 and 50, and has an aperture therethrough aligned with branch passage 24.

Diaphragm 38 and plate 40 move leftwardly to block branch passage 28 to provide the noted closed position of valve 22 in response to fuel pressure responsive pressure differential overcoming compression spring 36 such that fuel flow from inlet 16 and branch passage 28 is blocked from reaching left chamber 46 and outlet 18. Fuel flow from inlet 16, branch passage 24 and right chamber 44 is blocked by diaphragm 38 from reaching left chamber 46 and outlet 18. Diaphragm 38 and plate 40 move rightwardly to open branch passage 28 to provide the noted open position of valve 22 in response to air and/or vapor in fuel pump 2 causing insufficient pressure differential across the diaphragm. In this open position, the gases, including air and vapor, flow from inlet 16 through branch passage 28 and restriction orifice 34 and through left chamber 46 to outlet 18.

Figure 3:
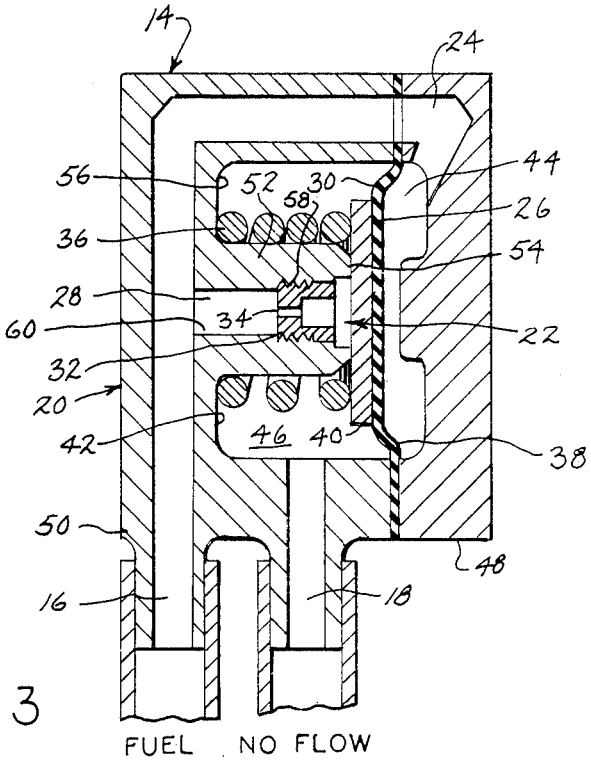
FIG. 3 is a view like FIG. 2, but showing a closed position.

Housing 20 includes an annular wall 52 defining branch passage 28 centrally therein and having an axial right end 54 engaged by plate 40 in the leftward closed position of diaphragm 38, FIG. 3. Compression spring 36 is disposed concentrically around annular wall 52 and bears between diaphragm 38 at plate 40 and housing wall section 56. Restriction plug 32 has a threaded outer surface 58 threadingly engaging the inner surface 60 of annular wall 52 defining branch passage 28 and is leftwardly screwed thereinto from axial end 54 engageable with plate 40 of diaphragm 38.

As above noted, valve 22 is in a normally open condition, allowing the purging of air and/or vapor. Spring 36 biases valve 22 to move in the same direction as flow through branch passage 28. Fuel pressure in right chamber 44 causes valve 22 to move in a direction opposite to the direction of flow through branch passage 28.

It is recognized that various alternatives and modifications are possible within the scope of the appended claims.

I claim:

1. In a fuel injection system for an internal combustion engine having a fuel pump communicating with a fuel tank and delivering pressurized fuel through a pressure line to a fuel injector, the improvement comprising purging means for purging gas, including air and vapor, from said system, comprising:

a housing having an inlet communicating with said pressure line, and having an outlet;

pressure responsive valve means in said housing movable between an open position permitting flow from said inlet to said outlet, and a closed position blocking flow from said inlet to said outlet;

a first branch passage in said housing communicating between said inlet and one side of said valve means;

a second branch passage in said housing communicating between said inlet and the other side of said valve means;

restriction means in said second branch passage selected to provide a fuel pressure drop thereacross but not substantially dropping gas pressure thereacross, such that pressurized fuel in said inlet is transmitted through said first and second branch passages to respective said one and other sides of said valve means and causes a higher pressure on said one side of said valve means than on said other side of said valve means to close said valve means to said closed position, and such that gas in said inlet is transmitted through said first and second branch passages to respective said one and other sides of said valve means but does not cause sufficient pressure differential across said valve means to close same such that said valve means is in said open position.

2. The invention according to claim 1 comprising biasing means biasing said valve means to said open position such that said valve means is normally open, and wherein the force of said biasing means is overcome by the differential pressure across said valve means responsive to said fuel pressure.

3. The invention according to claim 2 comprising a cavity in said housing, and wherein said valve means comprises a flexible diaphragm in said cavity dividing said cavity into a first chamber on one said of said diaphragm and a second chamber on the other side of said diaphragm, said first chamber being separated and sealed from said second chamber in said cavity by said diaphragm, said first chamber communicating with said first branch passage, said second chamber communicating with said second branch passage and with said outlet, said diaphragm moving to block said second passage to provide said closed position of said valve means in response to fuel pressure responsive pressure differential across said diaphragm overcoming said biasing means such that fuel flow from said inlet and said second branch passage is blocked from reaching said second chamber and said outlet, and fuel flow from said inlet, said first branch passage and said first chamber is blocked by said diaphragm from reaching said second chamber and said outlet, said diaphgram moving to open said second branch passage to provide said open position of said valve means in response to gas in said fuel pump causing said insufficient pressure differential across said diaphragm such that gas flows from said inlet through said second branch passage and said restriction means and through said second chamber to said outlet.

4. The invention according to claim 3 wherein said housing comprises an annular wall defining said second branch passage centrally therein and having an axial end engaged by said diaphgram in said closed position, and wherein said biasing means comprises a compression spring disposed concentrically around said annular wall and bearing between said diaphragm and said housing.

5. The invention according to claim 4 wherein said restriction means comprises a plug with a central axially extending orifice therethrough and having an outer surface engaging the inner surface of said annular wall defining said second branch passage.

6. In a fuel injection system for an internal combustion engine having a fuel pump communicating with a fuel tank and delivering presurized fuel through a pressure line to a fuel injector, the improvement comprising purging means for purging gas, including air and vapor, from said system, comprising:

a housing having an inlet communicating with said pressure line, and having an outlet;

pressure responsive valve means in said housing movable between an open position permitting flow from said inlet to said outlet, and a closed position blocking flow from said inlet to said outlet;

a branch passage connecting said inlet to said valve means;

means blasing said valve means to said open position in the same direction as flow through said branch passage;

valve closing means responsive to fuel pressure to move said valve means to said closed position in a direction opposite to the direction of flow through said branch passage.

7. The invention according to claim 6 wherein said branch passage and said biasing means are on one side of said valve means, and wherein said valve closing means applies fuel pressure to the other side of said valve means.

8. The invention according to claim 7 wherein said biasing means comprises a compression spring concentric to said branch passage and coaxial with the direction of flow through said branch passage.

9. The invention according to claim 7 wherein said valve means blocks fuel flow from said other side thereof to said outlet in both of said open and closed positions.

10. A fuel injection system for an internal combustion engine comprising:

a fuel tank for storing fuel;

fuel pump means for drawing fuel from said tank and supplying fuel under pressure to a pressure line;

a fuel injector connected to said pressure line for injecting pressurized fuel to said engine;

purging means for purging gas, including air and vapor, from said system, comprising:

a housing having an inlet communicating said pressure line, and having an outlet;

a cavity in said housing;

pressure responsive valve means comprising a flexible diaphragm in said cavity dividing said cavity into a first chamber on one side of said diaphragm and a second chamber on the other side of said diaphragm, said first chamber being separated and sealed from said second chamber in said cavity by said diaphragm, said valve means being movable between an open position permitting flow from said inlet through said second chamber to said outlet, and a closed position blocking flow from said inlet to said outlet;

a first branch passage in said housing communicating between said inlet and said first chamber on said one side of said diaphragm;

a second branch passage in said housing communicating between said inlet and said second chamber on said other side of said diaphragm;

restriction means in said second branch passage selected to provide a fuel pressure drop thereacross but not substantially dropping gas pressure thereacross, such that pressurized fuel in said inlet is transmitted through said first and second branch passages to respective said first and second chambers on opposite sides of said diaphragm and causes a higher pressure on said one side of said diaphragm than on said other side of said diaphragm to close said valve means to said closed position by moving said diaphragm to block said second branch passage, and such that gas in said inlet is transmitted through said first and second branch passages to respective said first and second chambers on opposite sides of said diaphragm but does not cause sufficient pressure differential across said diaphram to close same;

means biasing said valve means to said open position by biasing said diaphragm to open said second branch passage to a normally said open condition, wherein the force of said biasing means is overcome by the differential pressure across said diaphragm responsive to said fuel pressure such that fuel flow from said inlet and said second branch passage through said restriction means is blocked from reaching said second chamber and said outlet, and fuel flow from said inlet, said first branch passage and said first chamber is blocked by said diaphragm from reaching said second chamber and said outlet, said diaphragm moving to open said second branch passage to provide said open position of said valve means in response to gas in said fuel pump means causing said insufficient pressure differential across said diaphragm to overcome said biasing means such that gas flows from said inlet through said second branch passage and said restriction means and through said second chamber to said outlet.

11. The invention according to claim 10 wherein said biasing means biases said diaphragm to move in the same direction as flow through said second branch passage, and wherein fuel pressure in said first chamber moves said diaphragm in a direction opposite to flow through said second branch passage.

* * * * *